US011529274B2

(12) United States Patent
Peskin et al.

(10) Patent No.: US 11,529,274 B2
(45) Date of Patent: Dec. 20, 2022

(54) REMOVABLE POWER ASSIST FOR MANUAL WHEELCHAIR

(71) Applicant: RODA FUTURA, LLC, Miami, FL (US)

(72) Inventors: Evan Peskin, Miami, FL (US); Vivek Nagar, Bronx, NY (US); Audrey Wilson, Miami, FL (US); Jonathan Slavin, Beachwood, OH (US)

(73) Assignee: RODA FUTURA, LLC, Miami, FL (US)

( * ) Notice: Subject to any disclaimer, the term of this patent is extended or adjusted under 35 U.S.C. 154(b) by 99 days.

(21) Appl. No.: 17/169,399

(22) Filed: Feb. 5, 2021

(65) Prior Publication Data

US 2021/0161741 A1 Jun. 3, 2021

Related U.S. Application Data

(63) Continuation-in-part of application No. 16/689,931, filed on Nov. 20, 2019, now Pat. No. 10,945,899, (Continued)

(51) Int. Cl.

| | |
|---|---|
| ***A61G 5/04*** | (2013.01) |
| ***A61G 5/08*** | (2006.01) |
| ***A61G 5/02*** | (2006.01) |

(52) U.S. Cl.

CPC ..... *A61G 5/047* (2013.01); *A61G 5/025* (2013.01); *A61G 5/041* (2013.01); *A61G 5/08* (2013.01)

(58) Field of Classification Search

CPC ..... A61G 5/047; A61G 5/041; A61G 5/025; A61G 5/08

See application file for complete search history.

(56) References Cited

U.S. PATENT DOCUMENTS

| | | | |
|---|---|---|---|
| 1,273,684 | A | 7/1918 | Small |
| 2,798,565 | A | 7/1957 | Rosenthal et al. |

(Continued)

FOREIGN PATENT DOCUMENTS

| | | | |
|---|---|---|---|
| WO | 1992/010157 | A1 | 6/1992 |
| WO | 2004/047707 | A2 | 6/2004 |

*Primary Examiner* — Erez Gurari

(74) *Attorney, Agent, or Firm* — Hollowell Patent Group; Kelly Hollowell

(57) ABSTRACT

Apparatus and associated methods relate to a removable power assist for converting a manual wheelchair into an electronic wheelchair, based on configuring a friction roller to releasably engage with a wheelchair wheel, configuring the friction roller when engaged to drive the wheel through a contact surface with the wheel above the wheel center and behind the wheelchair seating area, configuring a motor to rotate the friction roller, and moving the wheelchair based on engaging the friction roller and activating the motor to turn the wheel through force by the friction roller against the contact surface with the wheel. The power assist may include a user-operable lever configured to engage or disengage the friction roller without a user leaving their seated position in the wheelchair. Configuring the friction roller above the wheel center and behind the wheelchair seating area may permit collapsible wheelchair folding or unfolding without uninstalling the power assist.

16 Claims, 9 Drawing Sheets

Related U.S. Application Data which is a continuation-in-part of application No. 16/395,391, filed on Apr. 26, 2019, now Pat. No. 10,517,780.

(60) Provisional application No. 62/663,289, filed on Apr. 27, 2018.

(56) References Cited

U.S. PATENT DOCUMENTS 3,100,547 A 8/1963 Rosenthal
3,100,860 A 8/1963 Rosenthal
3,786,887 A 1/1974 Rosenthal
3,814,199 A 6/1974 Jones
3,893,529 A 7/1975 Karchak, Jr.
4,050,533 A * 9/1977 Seamone ..... A61G 5/1054 180/907
4,140,192 A 2/1979 Sharpe
4,141,094 A 2/1979 Ferguson et al.
4,296,361 A 10/1981 Archer
4,418,776 A * 12/1983 Weirick ..... B62B 5/0026 280/DIG. 6
4,422,515 A * 12/1983 Loveless ..... A61G 5/1054 280/250.1
4,641,720 A 2/1987 Young
4,652,026 A * 3/1987 Byrge ..... A61G 5/022 280/255
4,805,711 A 2/1989 Lautzenhiser
4,961,473 A 10/1990 Jones
5,078,227 A 1/1992 Becker
5,125,468 A 6/1992 Coker
5,156,226 A 10/1992 Boyer et al.
5,222,567 A 6/1993 Broadhead
5,542,690 A * 8/1996 Kozicki ..... A61G 5/125 297/42
5,555,949 A 9/1996 Stallard et al.
5,562,174 A 10/1996 Chen
5,735,363 A 4/1998 Horovitz
5,762,154 A 6/1998 Hsu
5,938,282 A 8/1999 Epple
6,050,356 A 4/2000 Takeda et al.
6,145,612 A 11/2000 Dickie
6,273,212 B1 8/2001 Husted
6,371,228 B1 4/2002 Husted
6,547,018 B1 * 4/2003 Choi ..... A61G 5/1054 180/65.6
7,484,746 B2 2/2009 Mills
7,581,604 B2 9/2009 Torita
9,050,226 B2 6/2015 Husted et al.
10,124,666 B2 11/2018 Cunningham
10,167,051 B1 * 1/2019 Richter ..... A61G 5/02
10,517,780 B2 12/2019 Peskin et al.
10,919,602 B2 2/2021 Chi-Hsueh
10,945,899 B2 3/2021 Peskin et al.
11,154,443 B2 10/2021 Peskin et al.
2002/0019686 A1 2/2002 Ulrich
2003/0030244 A1 * 2/2003 Choi ..... A61G 5/025 280/252
2004/0007401 A1 1/2004 Chu
2005/0269797 A1 12/2005 Mitchel
2006/0017263 A1 * 1/2006 Chen ..... A61G 5/1086 280/647
2006/0096792 A1 * 5/2006 Usherovich ..... A61G 5/045 180/11
2010/0156063 A1 * 6/2010 Green ..... A61G 5/023 280/248
2010/0193278 A1 8/2010 Husted
2011/0304121 A1 * 12/2011 Chiu ..... A61G 5/047 280/304.1
2011/0308880 A1 * 12/2011 Chiu ..... A61G 5/047 180/312
2012/0080243 A1 * 4/2012 Mulhern ..... A61G 5/047 180/11
2012/0279789 A1 11/2012 Brill et al.
2014/0183930 A1 7/2014 Wei
2014/0232085 A1 8/2014 Hsiao-Wecksler
2016/0136019 A1 5/2016 Studebaker
2017/0065472 A1 * 3/2017 Cunningham ..... A61G 5/025
2018/0280213 A1 * 10/2018 Hancock ..... A61G 5/047
2019/0110940 A1 * 4/2019 Collura ..... A61G 5/047
2019/0291815 A1 * 9/2019 Viglione ..... B62J 11/13
2019/0328592 A1 * 10/2019 Peskin ..... A61G 5/08
2019/0350781 A1 * 11/2019 Ata ..... A61G 5/02
2020/0085653 A1 * 3/2020 Peskin ..... A61G 5/047
2021/0161741 A1 * 6/2021 Peskin ..... A61G 5/041
2021/0220196 A1 * 7/2021 Peskin ..... A61G 5/0816
2021/0282986 A1 * 9/2021 Goldish ..... A61G 5/047
2022/0062076 A1 * 3/2022 Traxinger ..... A61G 5/027

* cited by examiner

REMOVABLE POWER ASSIST FOR MANUAL WHEELCHAIR

CROSS-REFERENCE TO RELATED APPLICATIONS

This application is a continuation in part of U.S. patent application Ser. No. 16/689,931 filed Nov. 20, 2019, which is a continuation in part of U.S. patent application Ser. No. 16/395,391 filed Apr. 26, 2019, issued as U.S. Pat. No. 10,517,780 on Dec. 12, 2019, which claims priority to U.S. Provisional application Ser. No. 62/663,289 filed on Apr. 27, 2018, the entire contents of which are incorporated herein by references in their entirety.

BACKGROUND OF THE INVENTION

The present application generally relates to a removable power assist for a manual wheelchair, and more particularly relates to a device for converting a manual wheelchair into an electric wheelchair.

In 2011, an estimated 2.7 million Americans used a wheelchair on a regular basis; up from 1.8 million in 1995. Based off the 2011 Census, 46,000,000 Americans are disabled and receiving income-based assistance. Of that group, 18.2% report ambulatory difficulty. There is also a population that needs a wheelchair temporarily e.g. 2-12 months and would prefer not to incur the expense of an electronic wheelchair even though it is preferred over a manual wheelchair.

Electronic wheelchairs and many of the innovations in the field are very expensive; and there is a significant price gap between the most expensive manual wheelchair and the cheapest electronic wheelchair, which often ranges in the thousands of dollars. Other limitations of electric wheelchairs, in addition to cost, include: portability (foldable); weight; and structural bulk. There are devices on the market for converting manual wheelchairs to electronic wheelchairs but they are flawed so that they cannot be installed by an end user sitting in the chair, are heavy, not portable, have poor surface contact for the propulsion system and/or cannot be disengaged without uninstalling the device from the chair.

What is needed is a device for converting a manual wheelchair into a power driven system in a cost effective, portable, easy to install and use, lightweight, alternately convertible from electric to manual without uninstalling the device. The device should be adaptable to existing manual wheelchairs without the need of professional installation.

SUMMARY OF THE INVENTION

Apparatus and associated methods relate to a removable power assist for converting a manual wheelchair into an electronic wheelchair, based on configuring a friction roller to releasably engage with a wheelchair wheel, configuring the friction roller when engaged to drive the wheel through a contact surface with the wheel above the wheel center and behind the wheelchair seating area, configuring a motor to rotate the friction roller, and moving the wheelchair based on engaging the friction roller and activating the motor to turn the wheel through force by the friction roller against the contact surface with the wheel. The power assist may include a user-operable lever configured to engage or disengage the friction roller without a user leaving their seated position in the wheelchair. Configuring the friction roller above the wheel center and behind the wheelchair seating area may permit collapsible wheelchair folding or unfolding without uninstalling the power assist.

Disclosed are a device and method to convert a manual wheelchair into an electronic wheelchair. The device includes a joystick, a communication unit, a motor, a retractable friction roller, an engagement unit and a power source. The joystick is operably connected to a communication unit. The communication unit is operably connected to a motor. The motor includes an axle connected to a rotor. The retractable friction roller is mounted on the axle. The roller is placed in contact with a wheel of a manual wheelchair. The engagement unit is attached to the manual wheelchair to detachably attach the friction roller and the wheel. The power source is operably connected to the motor and the joystick.

In accordance with teachings of the present invention a device for converting a manual wheelchair into an electronic wheelchair is provided. Herein described is a manual wheelchair accessory device configured to attach to a manual wheelchair that will convert the manual wheelchair to an electric wheelchair, while still retaining the advantages that manual wheelchairs provide. The device includes an attachable power source affixed to a standard manual wheelchair.

In one embodiment, the present invention provides a device having a joystick, a communication unit, a motor, a retractable friction roller, an engagement unit and a power source. The joystick is operably connected to a communication unit. The communication unit is operably connected to a motor. The motor includes an axle connected to a rotor. A retractable friction roller is mounted on the axle. The roller is placed in contact with a wheel of a manual wheelchair. The engagement unit is attached to the manual wheelchair to detachably attach the friction roller to the wheel. The power source is operably connected to the motor and the joystick.

In one embodiment, the present invention provides a second motor that is operably connected to a second communication unit and the power source. The second communication unit is operably connected to the joystick. The second motor includes a second axle connected to a second rotor. This embodiment includes a second friction roller that is mounted on the second axle. The second roller is placed in contact with a second wheel of the manual wheelchair to facilitate powered motion. In another embodiment, the joystick may be operably connected to the rotors and is operably programmable to generate commands for the motors.

The present invention easily converts a manual wheelchair to a powered, smart wheelchair. Features of the present invention include 1) using the friction roller's contact to the wheel to generate directed movement; 2) the ability to engage and disengage the friction roller to the wheels of the wheelchair which allows the user to propel the wheelchair with manual propulsion while the device is still attached to the wheelchair—a feature essential if the battery or motor cease to function; 3) the ability to fold the wheelchair with device attached to it without altering the folding of or normal space occupied by a standard manual wheelchair; 4) unit portability. In one embodiment, the device includes a safety guard to prevent a user's fingers from becoming caught in the motor or the gears. In another embodiment, the motors are bi-directional and independent of one another so that the motor attached to each wheelchair wheel can turn the opposite direction and rotate the wheelchair in place. Using the present invention, both acute and long-term care wheelchair companies and individual users can affordably bring their equipment and standard of care to a higher, professional level.

DETAILED DESCRIPTION OF DRAWINGS

While various embodiments of the present disclosure are disclosed, it should be understood that they are presented as examples only, and are not intended to be limiting. Similarly, the drawings and diagrams depict structural or architectural examples or alternate configurations of the invention, which are provided to aid in understanding the features and functionality of the various embodiments of the invention but are not intended to be limiting. The embodiments and features may be implemented and/or altered in a variety of ways known to those of ordinary skill the art.

Figure 1:
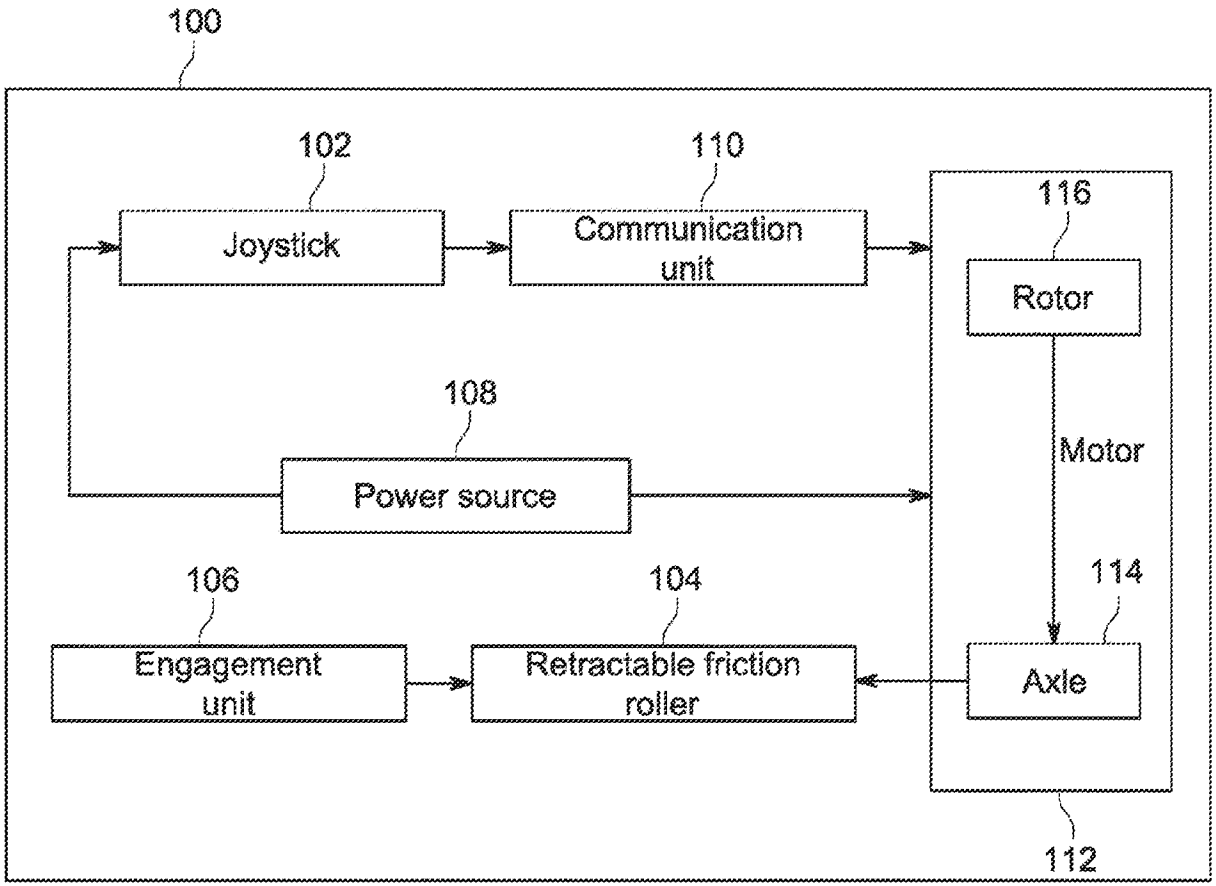
FIG. 1 illustrates a block diagram of a device in accordance with an embodiment of the present invention.

FIG. 1 illustrates a block diagram of the device 100 in accordance with one embodiment of the present invention. In this embodiment, the device 100 includes a joystick 102, a retractable friction roller 104, an engagement unit 106 and a power source 108. The joystick 102 is operably connected to a communication unit 110. The joystick 102 is explained in detail in conjunction with FIG. 2 and FIG. 3 of the present invention.

The communication unit 110 is operably connected to a motor 112. The communication unit 110 is explained in detail in conjunction with FIG. 2 of the present invention. The motor 112 includes an axle 114 and a rotor 116. The motor 112 is explained in detail in conjunction with FIG. 3 of the present invention. The axle 114 is shown and explained in detail in conjunction with FIG. 4 of the present invention.

The retractable friction roller 104 is mounted on the axle 114. During operation of the device 100, the retractable friction roller 104 is put in contact with at least one wheel 206 (shown in FIG. 2) of a manual wheelchair 202 (shown in FIG. 2). The retractable friction roller 104 is explained in detail in conjunction with FIG. 3 and FIG. 4 of the invention.

Figure 2:
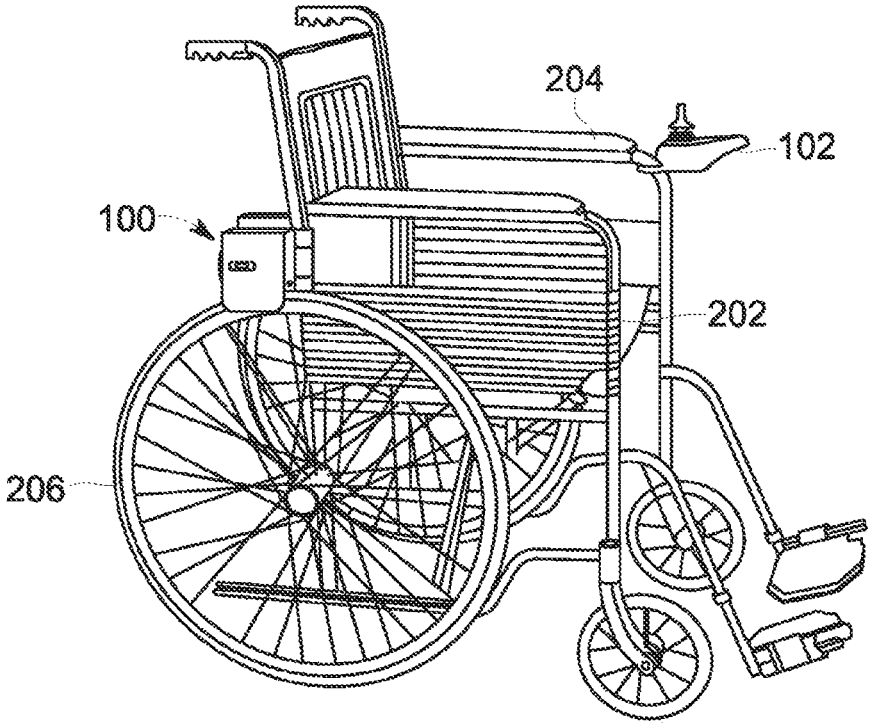
FIG. 2 illustrates a side view of a device attached to a manual wheelchair in accordance with an embodiment of the present invention.

The engagement unit 106 is attached to the wheelchair 202 (shown in FIG. 2) to detachably attach the retractable friction roller 104 and the wheel (shown in FIG. 2). The engagement unit 106 is explained in detail in conjunction with FIG. 3, FIG. 4 and FIG. 5 of the present invention. The power source 108 is operably connected to the motor 112 and the joystick 102. The power source 108 is shown and explained in detail in conjunction with FIG. 5 of the present invention. The device 100 converts the manual wheelchair 202 into an automatic wheelchair.

FIG. 2 illustrates a side view of one embodiment of device 100 attached to a manual wheelchair 202. The joystick 102 allows the user to control the direction and speed of the motor 112 (shown in FIG. 2). In an embodiment, the joystick 102 is attached to an arm 204 of the manual wheelchair 202.

In one embodiment, a user is able to control the direction, movement and speed of the device 100 using the joystick 102. More specifically, the movement and speed of the wheel 206 of the wheelchair 202 is controlled by user instructions using the joystick 102 and the communication unit 110 (shown in FIG. 3).

In an embodiment the communication unit 110 (shown in FIG. 3) and the second communication unit 304 (shown in FIG. 3) is a wired communication unit. Examples of the communication unit 110 (shown in FIG. 3) and the second communication unit 304 (shown in FIG. 3) include but not limited to cables, wires, Bluetooth, NFC. It would be readily apparent to those skilled in the art that various types of communication unit such as wired or wireless unit may be envisioned without deviating from the scope of the present invention.

In one embodiment, the joystick 102 is programmable and enabled to store instructions for controlling the speed and direction of motor 112 (shown in FIG. 1). The joystick 102 receives power from the power source 108 (shown in FIG. 1). The use of a battery operated joystick is known for controlling power wheelchairs. The joystick 102 may be a device that is compatible with commercially available joystick devices designed to be plugged in and disconnected by an end user, to reduce user effort and expense replacing the joystick due to wear and tear through normal use. The joystick 102 may be a Bluetooth enabled joystick, permitting remote control of the wheelchair within the communication range of the device using a wireless joystick that is not physically installed in the wheelchair. For example, the user riding in the wheelchair may hold a Bluetooth enabled or wireless joystick 102 in either hand, or in any way that is comfortable or effective, to operate their wheelchair without constraint by a wired or permanently installed joystick. The joystick 102 may include a pop socket ring holder configured to permit a user to effectively manipulate a wireless joystick that is not physically installed in the wheelchair.

In one embodiment, the power source 108 is a battery. The batteries may be rechargeable such as but not limited to using an ordinary 110V or 220V charger. Sample batteries that may work with this device include but are not limited to a primary battery (non-chargeable) and secondary batteries such as Lithium-ion (Li-ion), Nickel Cadmium (Ni—Cd), Nickel-Metal Hydride (Ni-MH) and Lead-Acid.

Figure 3:
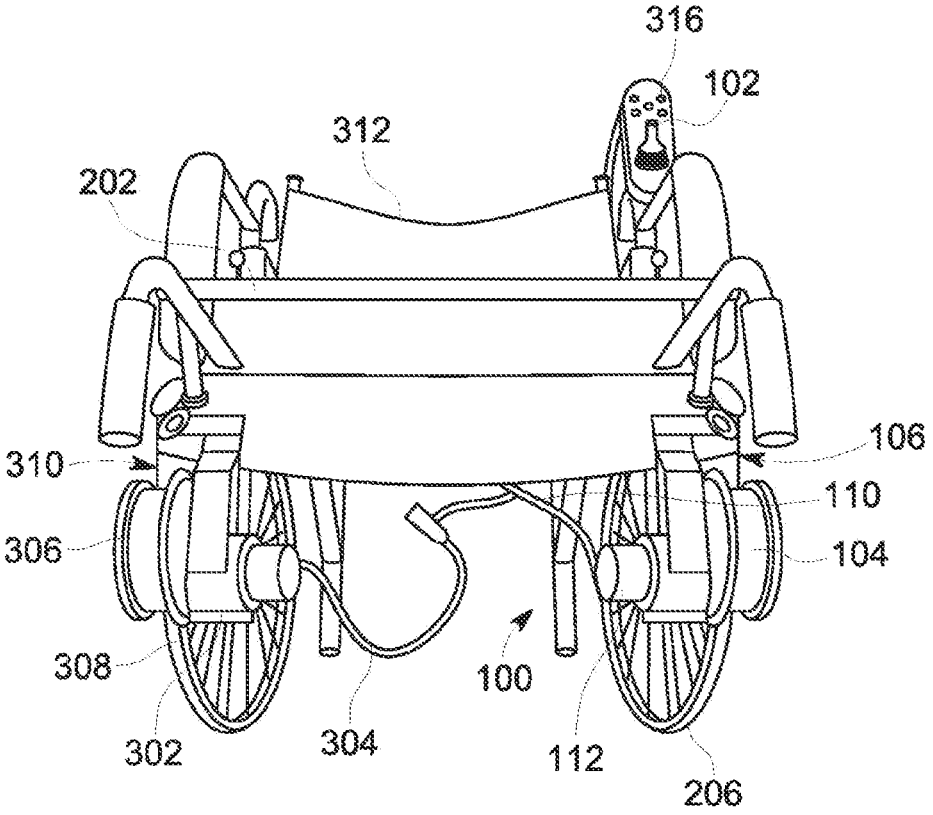
FIG. 3 illustrates a top perspective view of the device attached to the manual wheelchair in accordance with an embodiment of the present invention.

FIG. 3 illustrates a top perspective view of the device 100 attached to the manual wheelchair 202 in accordance with an embodiment of the present invention. In this configuration, the retractable friction roller 104 is mounted on the axle 114 (shown in FIG. 1) and rotated by activation of the motor 112.

In one embodiment, the device includes a brushless hub motor with a friction surface. Types of motors that may be used include but are not limited to a geared hub motor, a brushed hub motor, a brushless geared hub motor, a brushed geared hub motor, a brushed geared hub motor, or any other similar motor. Hub motors are very common in power wheelchairs but are typically used for separate wheels that contact the ground directly.

In the present invention, the retractable friction roller 104 is placed in contact with at least one wheel 206 of the manual wheelchair 202 to rotate the wheel 206 and move the wheelchair 202. The retractable friction roller 104 rotates the wheel 206 by friction force. This is a unique feature of the present invention. Other devices are commonly based on motor to ground movements, PAW uses a friction roller to the wheel to generate movement.

In one embodiment, the retractable friction roller 104 is shaped to have a centerless concave rim housing configured to provide high friction surface facing the wheel 206 of the wheelchair 202. The centerless concave rim housing acts as a wheel hub to yield a high percentage of surface contact. In one embodiment, the high friction surface of the retractable friction roller 104 faces the wheelchair wheel 206 and is customizable to fit the curve and or size of the wheel 206.

In an embodiment, the material of high friction surface of the retractable friction roller 104 is rubber or polyurethane. However, it would be readily apparent to those skilled in the art that various types of material such as silicone, foam, sand paper, grit tape, sponge-rubber foam etc. may be envisioned without deviating from the scope of the present invention. In another embodiment, the wheels 206 of wheelchair 202 are made using a high friction surface, and the roller 104 is made of steel, aluminum or other similar hardened, textured surface.

The motor 112 is configured to rotate the retractable friction roller 104. The retractable friction roller 104 is mounted on the axle 114 (shown in FIG. 1) and the rotor 116 (shown in FIG. 1) rotates the first axle resulting in rotation of the retractable friction roller 104. In an embodiment, the motor 112 is a brushless DC motor with a friction surface. However, it would be readily apparent to those skilled in the art that various types of motor such as geared hub motor, brushed hub motor, brushed geared hub motor etc. may be envisioned without deviating from the scope of the present invention.

In another embodiment, the device 100 further includes a second motor 302 operably connected to a second communication unit 304 and the power source 108 (shown in FIG. 1). The communication unit 110 and the second communication unit 304 are both operably connected to the joystick 102. In another embodiment, the joystick 102 further include control buttons 316 operably connected to the motor. The control buttons 316 controls speed of the motor 112 (shown in FIG. 3).

The second motor 302 includes a second axle (not shown) connected to a second rotor (not shown). In this embodiment, the device 100 further includes a second friction roller 306 mounted on the second axle (not shown). The second roller 306 is placed in contact with a second wheel 308 of the manual wheelchair 202. Alternatively, the second roller 306 is mounted to the axle 114 and the motor 112 provides motor torque to rotate the second friction roller 306 and the friction roller 104 (not shown).

Similarly, to the retractable friction roller 104, the second retractable friction roller 306 includes a centerless concave rim housing configured to provide high friction surface facing the second wheel 308 of the wheelchair 202. The principle and function of the second motor 302 and second friction roller 306 is the same as the motor 112 and retractable friction roller 104 as previously described.

In another embodiment of the present invention, the device 100 further includes a second engagement unit 310 attached to the manual wheelchair 202 to detachably attach the second friction roller 306 and the second wheel 308 of the wheelchair 202. The engagement unit 106 detachably attaches the friction roller 104 and the wheel 206. The engagement unit 106 and the second engagement unit 310 is attached behind seating area 312 of wheelchair 202 and top of the wheel 206 and the second wheel 308, respectively.

Figure 4:
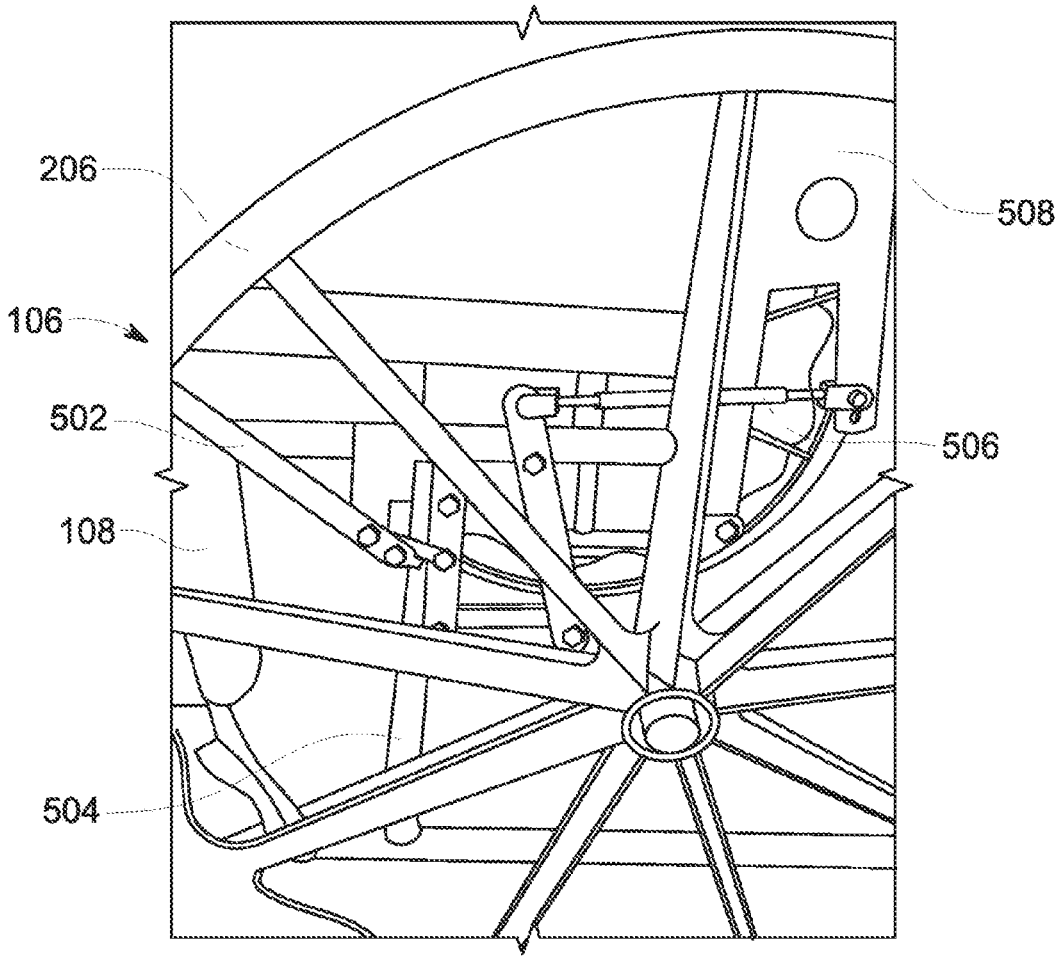
FIG. 4 illustrates a perspective view of an engagement unit in accordance with another embodiment of the present invention.

FIG. 4 illustrates perspective view of engagement unit 106 in accordance with another embodiment of the present invention. The engagement unit 106 includes a lever 502 operably connected to a lever mechanism unit 504, a turnbuckle 506 connected to the lever mechanism unit 504 and an attachment unit 508 operably connected to the turnbuckle 506. The attachment unit 508 comprises clamps (shown in FIG. 5) and a spring loaded unit (shown in FIG. 5).

The retractable friction roller (104, shown in FIG. 3) is operably connected to the turnbuckle 506. The lever 502 is actuated by the user and results in engaging and disengaging of the retractable friction roller (104, shown in FIG. 3) from the wheel 206. Thus, the lever 502 results in converting a manual wheelchair into an electronic wheelchair and vice versa.

Figure 6:
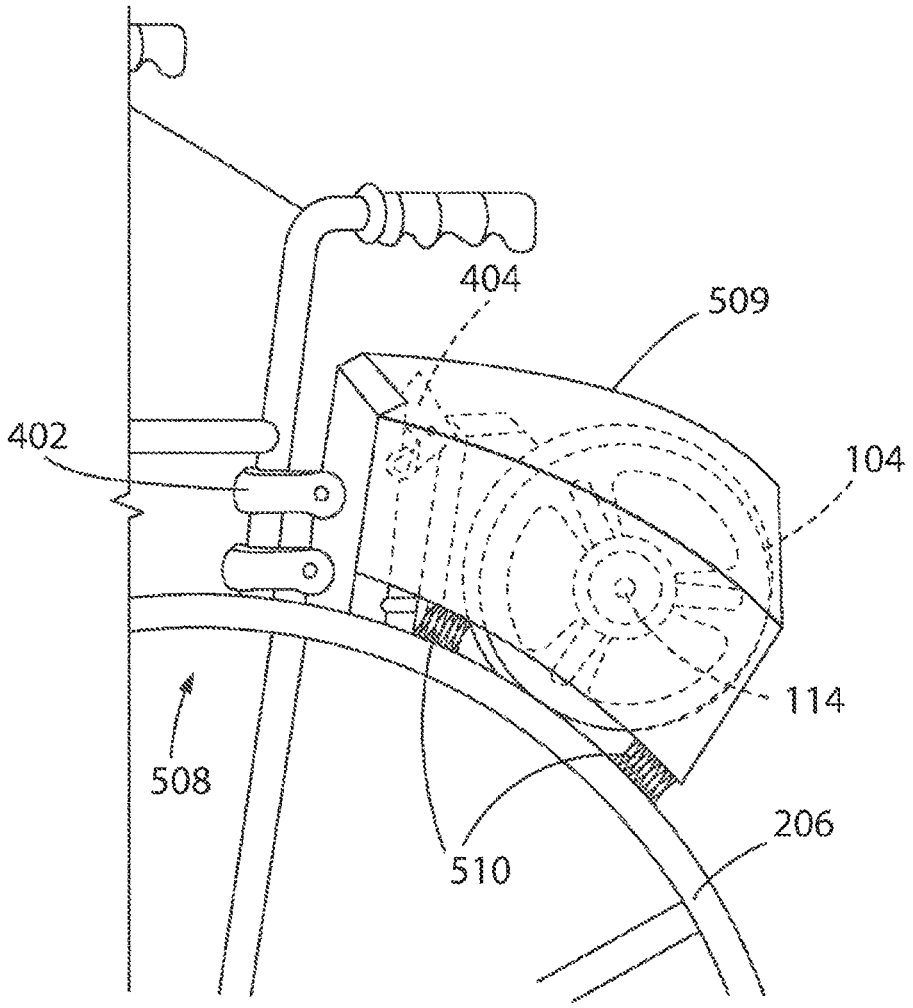
FIG. 6 illustrates a perspective view of the device with a protective fender in accordance with another embodiment of the present invention.

In FIG. 6 another embodiment of the device 100 is shown with a safety fender 509 also herein referred to as a cover, protective cap and/or shield; which comprises a top, an open bottom, a right side, a left side, a proximal side and distal side wherein each of the four sides has a bottom edge and at least one set of brushes 510 is attached to the bottom edge of the distal side of the safety fender 509 and the safety fender 509 is detachably attached to the wheelchair 202 such as but not limited to attachment by clamps 402 and wherein the safety fender 509 fits over the attachment friction roller 104. The safety fender 509 may be attached to a motor 112 (depicted at least in FIG. 3). The safety fender 509 may be attached to a second motor 302 (depicted at least in FIG. 3). The safety fender 509 may be attached to a bracket 704 (depicted at least in FIGS. 7A-7B). In one embodiment, the at least one set of brushes 510 are positioned on the bottom edge of the distal side of the fender so that the brushes 510 contact the wheel 206 of the wheelchair 202. In one embodiment, there are at least two sets of brushes 510 with one set of brushes positioned on the bottom edge of the distal side of the fender and the other set of brushes 510 positioned on the bottom side of the bottom edge of the proximal side of the fender. That is in front of and behind the friction roller 104 where friction roller 104 comes into contact with the wheel 206. It will be apparent to one of ordinary skill in the art that placement of the at least one set of brushes 510 may vary to optimize the contact between the friction roller 104 and the wheel 206. This is accomplished in part as the at least one set of brushes function to brush away and or clearing debris from coming in between the friction roller 104 and the wheel 206.

In one embodiment, the cover 509 is a protective barrier that shields the top and four sides of the protects the friction roller 104 and axle 114 from environmental exposure, debris and damage. In this regard, the fender 509 may improve the long-term use and function of the device 100 by protecting the friction roller 104 and axle 114 from environmental exposure and preventing environmental debris from impacting or entering into the inner functioning components of the device 100 motor through contact of the wheel 206 with the with the friction roller 104. The fender 509 is also a safety device. More specifically, the fender 509 improves the safety of the user by preventing clothing, hair, hands and fingers from being caught, snagged or trapped by the device especially as the wheel 206 rotates.

Figure 7A:
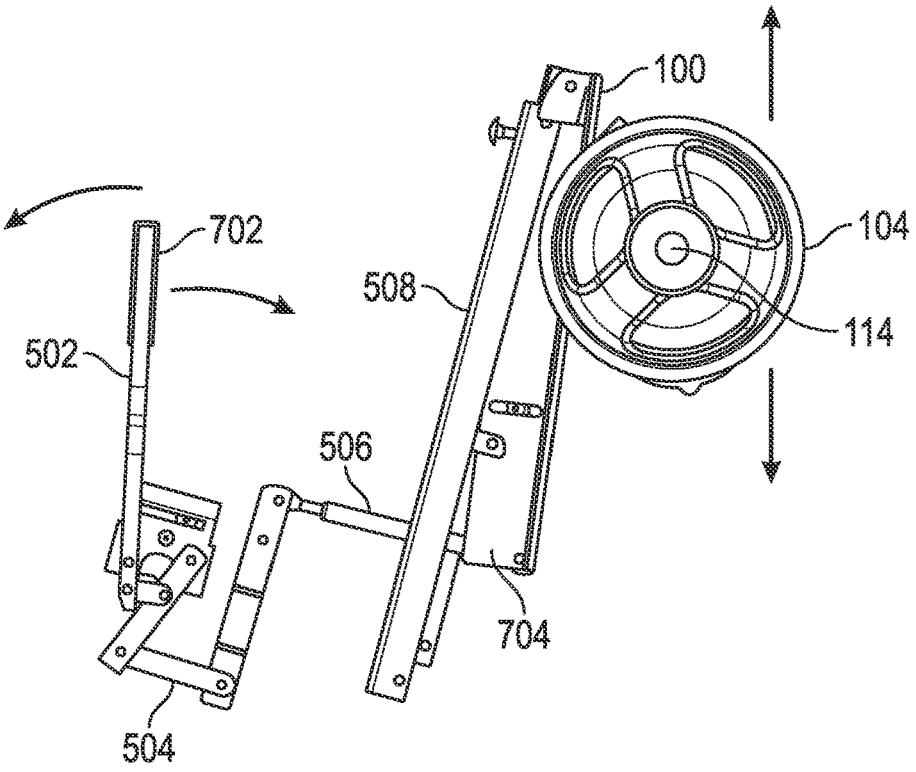
FIGS. 7A-7B together illustrate side views of exemplary wheelchair power assist device components.
Figure 7B:
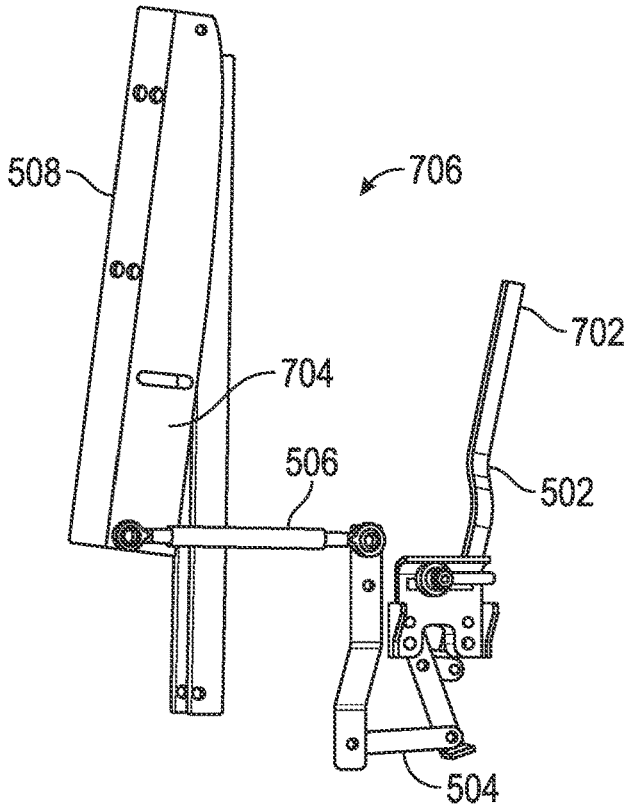

FIGS. 7A-7B together illustrate side views of exemplary wheelchair power assist device components. In FIG. 7A, the exemplary wheelchair power assist device 100 includes the friction roller 104 mounted to the axle 114. In the depicted example, the friction roller 104 is attached to a motor 112 (depicted at least in FIG. 3) and the motor 112 is attached to the bracket 704. The friction roller 104 may be attached to the bracket 704. In the illustrated example, the bracket 704 is configured to attach the motor 112 (depicted at least in FIG. 3) to a wheelchair 202 (depicted at least in FIG. 3) via the attachment unit 508. The bracket 704 may be configured to attach a second motor 302 (depicted at least in FIG. 3) with a second friction roller 306 (depicted at least in FIG. 3) and second axle 114 (depicted at least in FIG. 5), to adapt another of the two main wheels of an exemplary wheelchair 202 with a second wheelchair power assist device 100. In the depicted example, the top of the bracket 704 is pivotally coupled with the top of the attachment unit 508. The top of the bracket 704 may be pivotally coupled with the top of the attachment unit 508 by a swivel pin, for example. In the depicted example, the bottom of the bracket 704 is connected with the turnbuckle 506. Pivotally coupling the top of the bracket 704 with the top of the attachment unit 508, and connecting the bottom of the bracket 704 with the turnbuckle 506, permits the lower portion of the bracket 704 to move relative to the attachment unit 508 in response to operation of the lever 502 by the handle 702. In the depicted example, moving the lever 502 drives the turnbuckle 506 via the lever mechanism unit 504, thereby raising or lowering the friction roller 104 to releasably engage the friction roller 104 and a wheel 206 (depicted at least in FIG. 5) via operation of the lever mechanism unit 504. In the example depicted by FIG. 7A, the lower portion of the bracket 704 has been displaced away from the attachment unit 508 by operation of the lever 502.

In FIG. 7B, the exemplary wheelchair power assist device 100 operation unit 706 assembly includes the turnbuckle 506 connected to the bracket 704 and the lever mechanism unit 504. The lever mechanism unit 504 operably couples the lever 502 and handle 702 with the bracket 704 via the turnbuckle 506, permitting a user to releasably engage a friction roller 104 (depicted at least in FIG. 7A) and a wheel 206 (depicted at least in FIG. 5) via operation of the lever mechanism unit 504. In the example depicted by FIG. 7B, the lower portion of the bracket 704 has been displaced toward the attachment unit 508 by operation of the lever 502.

Figure 8:
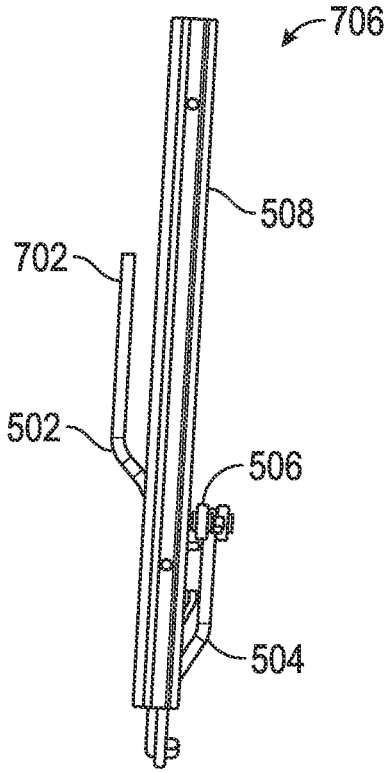
FIG. 8 illustrates a side view of an exemplary wheelchair power assist device operation unit assembly in an exemplary retracted configuration.

FIG. 8 illustrates a side view of an exemplary wheelchair power assist device operation unit assembly in an exemplary retracted configuration. In FIG. 8, the exemplary wheelchair power assist device operation unit assembly 706 components are shown retracted to collapse the operation unit assembly 706 to facilitate space-efficient storage and transport. In the depicted example, the exemplary wheelchair power assist device operation unit assembly 706 retracted configuration includes the lever 502 and handle 702 coupled via the lever mechanism unit 504 and turnbuckle 506 with the bracket 704 (depicted at least in FIGS. 7A and 7B) and attachment unit 508.

Figure 9:
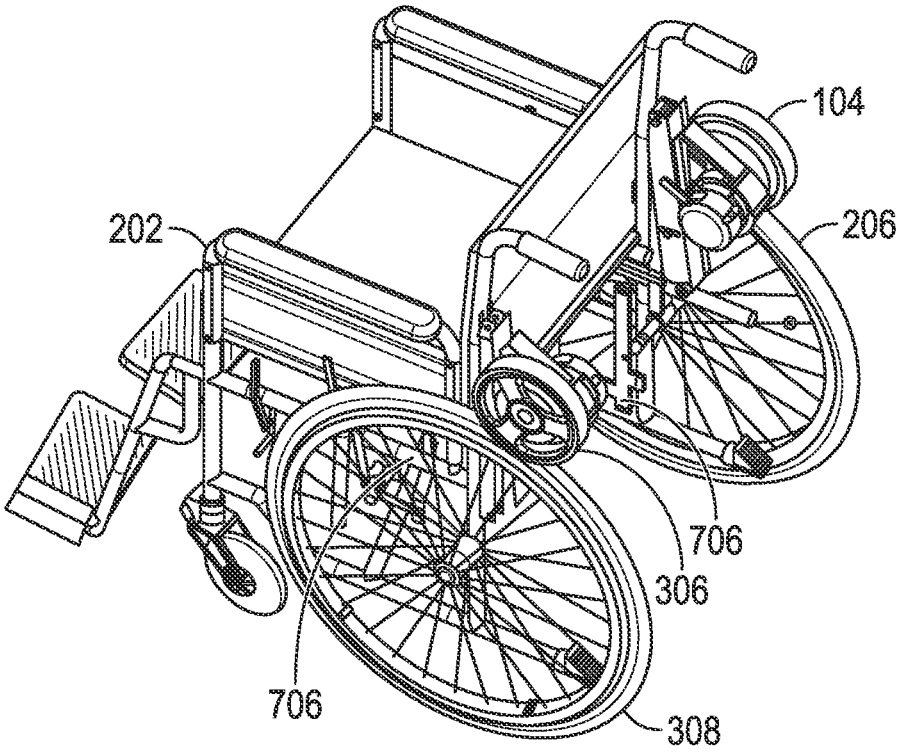
FIG. 9 illustrates a top perspective view of an exemplary wheelchair with two illustrative power assist devices each configured to drive one of the two depicted wheelchair main wheels.

FIG. 9 illustrates a top perspective view of an exemplary wheelchair with two illustrative power assist devices each configured to drive one of the two depicted wheelchair main wheels. In FIG. 9, the exemplary wheelchair 202 includes the main wheels 206 and 308. In the depicted example, the wheelchair 202 is configured with a wheelchair power assist device operation unit assembly 706 to drive the main wheel 206 via the friction roller 104. In the illustrated example, the wheelchair 202 is configured with a second wheelchair power assist device operation unit assembly 706 to drive the second main wheel 308 via the second friction roller 306. Configuring the friction roller 104 and 306 above the respective wheels 206 and 308, and at the rear of the wheelchair 202, permits wheelchair power assist device installation and removal from behind the wheelchair while the wheelchair 202 seat is occupied by a person riding in the wheelchair 202. While riding in the wheelchair 202, a person riding may releasably engage power assist to the wheel 206 by operating the lever 502 (depicted in FIGS. 7A and 7B) of the wheelchair power assist device operation unit assembly 706. The person while riding in the wheelchair 202 may releasably engage power assist to the second wheel 308 by operating the lever 502 (depicted in FIGS. 7A and 7B) of the second wheelchair power assist device operation unit assembly 706. When power assist to the wheels is disengaged by operation of the lever 502, the friction rollers 104 and 306 disengage from the respective wheelchair 202 wheels 206 and 308, and the wheelchair 202 operates normally with manual propulsion by the user turning the wheels 206 and 308 by hand. The person riding in the wheelchair 202 under manual propulsion may engage power assist to the wheels 206 and 308 by operating the lever 502, to engage the friction rollers with the wheels.

Figure 10A:
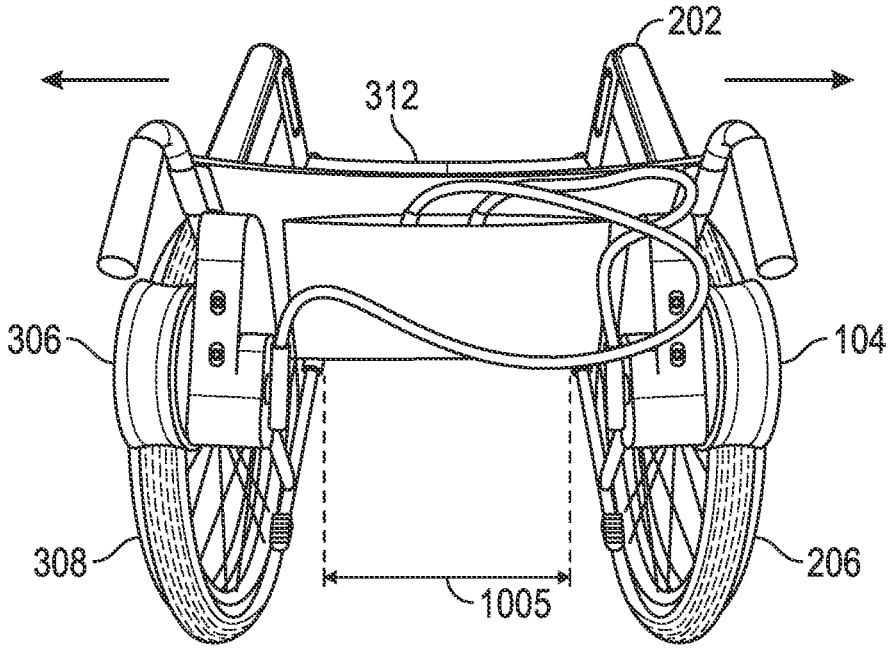
FIG. 10A illustrates a rear perspective view of an exemplary wheelchair with two illustrative power assist devices each configured to drive one of the two depicted wheelchair main wheels, with the wheelchair in an exemplary unfolded configuration.

FIG. 10A illustrates a rear perspective view of an exemplary wheelchair with two illustrative power assist devices each configured to drive one of the two depicted wheelchair main wheels, with the wheelchair in an exemplary unfolded configuration. In FIG. 10A, the exemplary wheelchair 202 is a collapsible wheelchair depicted in an illustrative unfolded configuration. In the depicted example, the friction roller 104 is configured to drive the wheel 206 by an exemplary power assist device (depicted for example by FIGS. 1-6, 7A-B, and 8-9). In the illustrated example, the second friction roller 306 is configured to drive the second wheel 308 by an exemplary second power assist device (depicted for example by FIGS. 1-6, 7A-B, and 8-9). In the depicted example, the friction rollers 104 and 306 are configured above the respective wheels 206 and 308, and behind the wheelchair 202 seating area 312. In the illustrated example, configuring the friction rollers 104 and 306 above the respective wheels 206 and 308, and behind the wheelchair 202 seating area 312, permits folding and unfolding the collapsible wheelchair 202 while the power assist devices remain installed, as a result of leaving open the space 1005 between the power assist devices. The friction rollers 104 and 306 may be disposed above the center of the respective wheels 206 and 308, between the respective wheel centers and the tops of the wheels, or above the wheels as depicted, to facilitate leaving open the space 1005 and permit folding and unfolding the collapsible wheelchair 202 while the power assist devices remain installed. In the illustrated example, the space 1005 is also left open as a result of the power assist device design that includes separate and distinct power assist devices each configured to drive one of the wheels 206, 308, without power assist device components occupying the space 1005. The wheelchair 202 may be folded while the power assist remains installed or attached to the wheelchair 202, independent of whether the power assist is engaged or disengaged, without affecting the folding action of the wheelchair 202, as a result of leaving the space 1005 open between the two power assist devices each configured to drive one of the wheels 206 and 308.

Figure 10B:
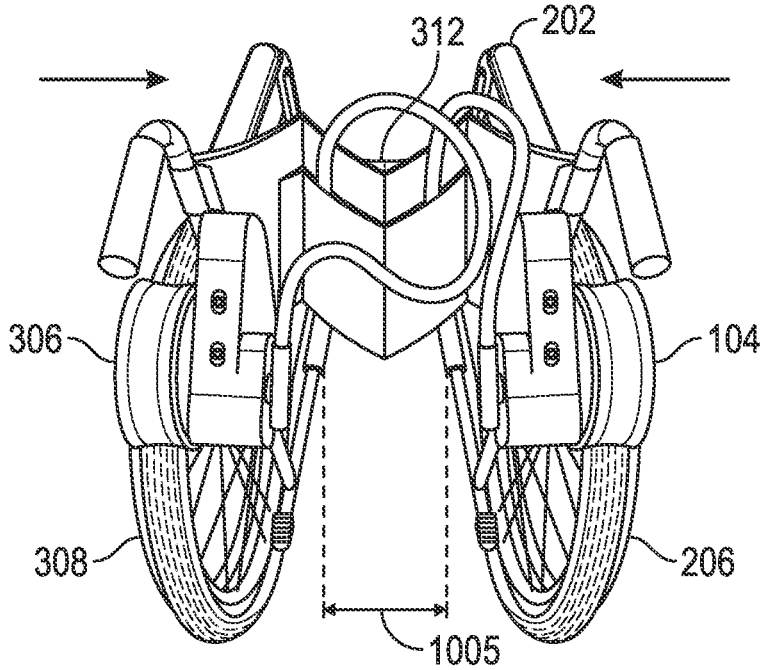
FIG. 10B illustrates a rear perspective view of an exemplary wheelchair with two illustrative power assist devices each configured to drive one of the two depicted wheelchair main wheels, with the wheelchair in an exemplary folded configuration.

FIG. 10B illustrates a rear perspective view of an exemplary wheelchair with two illustrative power assist devices each configured to drive one of the two depicted wheelchair main wheels, with the wheelchair in an exemplary folded configuration. In FIG. 10B, the exemplary wheelchair 202 is a collapsible wheelchair depicted in an illustrative folded configuration. In the depicted example, the friction rollers 104 and 306 are configured above the respective wheels 206 and 308, and behind the wheelchair 202 seating area 312. In the illustrated example, the collapsible wheelchair 202 has been folded while the power assist devices remained installed. This facilitation may be a result of the depicted power assist design, that leaves open the space 1005 between the power assist devices and behind the wheelchair 202 seating area 312, without power assist device components occupying the space 1005.

With reference to FIG. 1, in an embodiment of the present invention, the power source 108 is a battery. The batteries are chargeable using an ordinary 110V or 220V charger. Examples of battery include but not limited to primary battery (non-chargeable) and secondary batteries such as Lithium-ion (Li-ion), Nickel Cadmium (Ni—Cd), Nickel-Metal Hydride (Ni-MH), and Lead-Acid.

Figure 5:
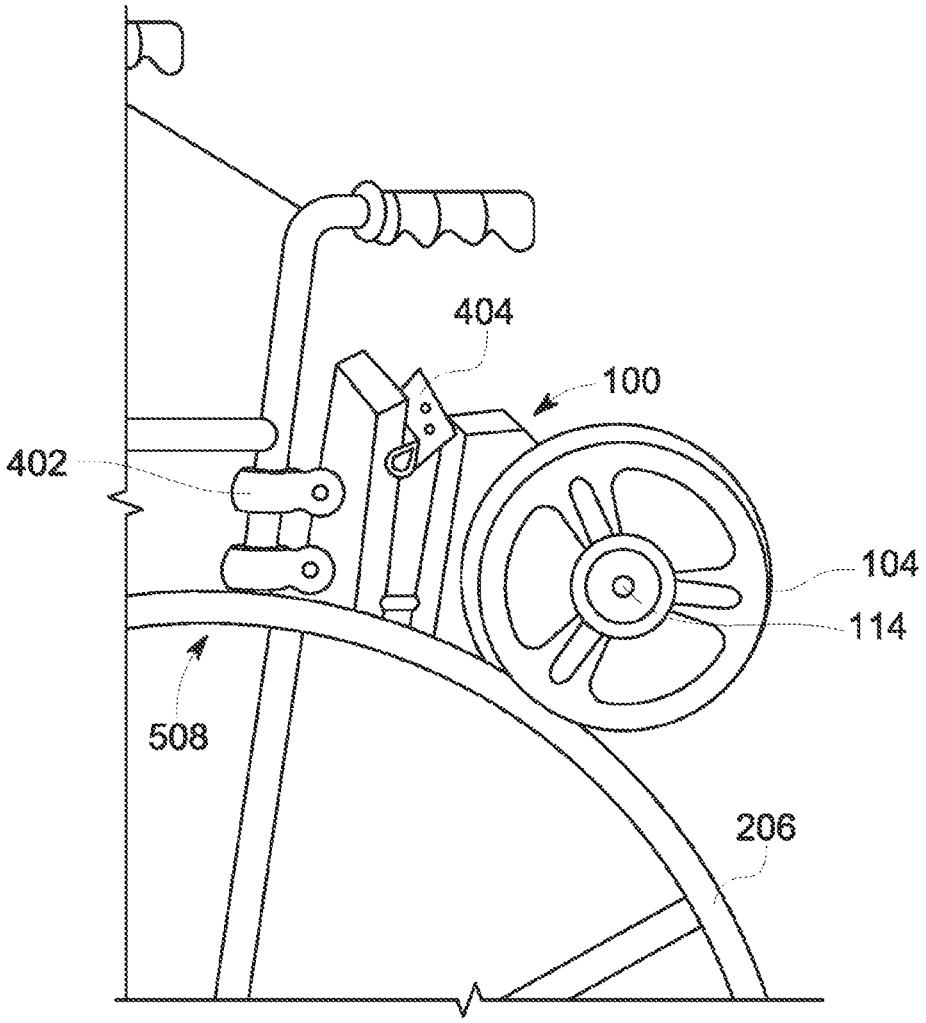
FIG. 5 illustrates a perspective view of the device in accordance with another embodiment of the present invention.

FIG. 5 illustrates perspective view of the device 100 in accordance with another embodiment of the present invention. The attachment clamps 402 and a spring loaded unit 404 engage and disengage the retractable friction roller 104 and the wheel 206.

With reference to FIG. 1, the friction roller 104 is mounted on the axle 114. In an embodiment of the present invention, the friction roller 104 has an opening to receive the axle 114. The axle 114 is a cylindrical elongated rod to pass through the opening to rotate the friction roller 104 on receiving motor torque from the rotor (116, shown in FIG. 1).

Examples of the attachment unit 508 are simple mechanical device such as but not limited to spring, screw clamp, mechanical coupling, latch, rod clamp, rail clamp, light, round center mount, mount bracket, pole clamp, pipe clamp, quick release clamp, rack clamp mount, or handlebar clamp mount on the backrest frame of wheelchair 202 and provides contact between the friction roller 104 and the wheelchair wheel 206, respectively.

The total weight for the entire device 100 is approximately 20 pounds. It is expected that the speed is 0-5 MPH adjustable, maximum carrying capacity of up to 260 pounds, with a maximum incline up to 10 degrees. In one embodiment, the product is classified as a Class 1 device under FDA Code of Federal Regulations Title 21 Subpart D Section 890.3910. In another embodiment, the device 100 is exempt from needing direct FDA approval, but would require a 510(k) license.

It would be readily apparent to those skilled in the art that second retractable friction roller; second engagement unit; and second motor performs exactly same functions as described in the description for retractable friction roller; engagement unit; and motor respectively.

In other embodiments one of ordinary skill in the art will be able and may make changes to the size and materials of the friction roller; the size and type of motor or battery used; and/or the type of controller or joystick; and the size and type of attachment devices used to fix the device to the manual wheelchair such as but not limited to a screw clamp. In one embodiment a casing for each of the two units may be added for safety, convenient travel and appearance. In another embodiment, the device may be used as a power assist to any object that is traditionally transported on wheels via manual propulsion, such as baggage carts.

Some wheelchair power assist device designs may be adapted with a sensor, and configured to automatically stop the wheelchair in an emergency situation detected based on information captured by the sensor. For example, an exemplary wheelchair may be configured to determine the speed of the wheelchair relative to the ground based on sensor data, compare the detected speed to a predetermined maximum safe speed, and automatically mitigate the unsafe speed based on stopping a motor, reducing the speed of a motor, or reversing a motor. The speed sensor may be, for example, a shaft encoder configured in a wheel. The speed sensor may be a Time of Flight (ToF) sensor pointed forward from the wheelchair passenger, in line with the direction the passenger would typically face.

Various wheelchair power assist device implementations may include an emergency kill switch configured to permit a user to manually stop the wheelchair in an emergency situation detected by the user. For example, the joystick may be configured with a button adapted to stop the motor to prevent serious injury or damage in an emergency situation. The switch may be configured as a dead-man switch, which would have to be actively engaged by a user seated in the chair for the wheelchair power assist to move the wheelchair. In some cases, the dead-man switch may be implemented with a key lock configured to prevent the motor from activating unless the key is present and turned to the activate position. The dead-man switch may be a weight sensor configured in the wheelchair seat, to prevent motor activation unless body weight of at least a predetermined threshold weight is detected in the wheelchair seat. The threshold weight may be configurable to a specific numeric weight, or to a weight selectable from a range of weights. The dead-man switch may be configured to stop the motor if the wheelchair passenger leaves the wheelchair seat.

Some wheelchair power assist device designs may include one or more handle configured to permit a user to grasp the one or more handle while carrying the device. The one or more handle may me rotatably secured with swivels to reduce the user's effort balancing the load while carrying the device. The one or more handle may be configured with a latch mechanism to secure the handle in the wheelchair power assist device when the handle is not in use.

In some wheelchair power assist device implementations, lights may be configured on the front or back of the device. The lights may be warning lights, configured to be visible to others not riding in the wheelchair. The lights may be headlights such as spotlights or floodlights, configured to improve the effective vision of the person riding in the wheelchair. Warning lights may be various colors and may be configured to blink or flash in various patterns to warn others or make the wheelchair more visible to others. Headlights or spotlights may be configured with a swivel mount permitting the wheelchair passenger to manually direct light in a direction of interest. In an illustrative example, the light swivel mount direction may be adjustable in pan and tilt modes under control of motors governed by the joystick.

Various wheelchair power assist device power source designs may include an interchangeable battery replacement system configured to adapt batteries of various diverse form factors and electrical connection geometries to a common form factor designed to electrically connect to and power the wheelchair.

Potential limitations include the following: the device may not work if the maximum weight limit is exceeded; the maximum incline is exceeded; the friction roller is not engaged properly to the powertrain; operation on wet surfaces due to slippage, operation on ice, sand, or oily surfaces, if the battery, motor, or grip components are damaged, if the wheels are locked or do not freely rotate, or if operated in excessive heat.

In an aspect, a method to convert a manual wheelchair (202) to an electronic wheelchair is disclosed, the method comprising: operably connecting a joystick (102) to a communication unit (110); operably connecting the communication unit (110) to a motor (112); connecting an axle (114) to a rotor (116); connecting the motor (112) to the axle (114); mounting a retractable friction roller (104) on the axle (114); configuring the retractable friction roller (104) with a centerless concave rim housing designed to provide a high friction surface when the friction roller (104) is placed facing and in contact with a wheel (206); placing the retractable friction roller (104) in contact with a wheel (206) of a manual wheelchair (202); attaching to the wheelchair (202) an engagement unit (106) configured to detachably attach the retractable friction roller (104) and the wheel (206); and operably connecting a power source (108) to the motor (112) and the joystick (102).

The method may further comprise configuring a safety fender (509) to detachably attach to the wheelchair (202), wherein the safety fender (509) fits over the retractable friction roller (104) when the safety fender (509) is attached to the wheelchair (202).

The method may further comprise attaching at least one set of brushes (510) to the safety fender (509), wherein the at least one set of brushes (510), when attached to the safety fender (509), are in contact with the wheel (206), and wherein the safety fender (509) comprises a top, an open bottom, a right side, a left side, a proximal side and a distal side, wherein each of the sides has a bottom edge and the at least one set of brushes (510) is attached to the bottom edge of the distal side of the safety fender (509).

The method may further comprise configuring the engagement unit (106) with a lever (502); operably connecting the lever (502) to a lever mechanism unit (504); operably connecting the lever mechanism unit (504) to a turnbuckle (506); and operably connecting the turnbuckle (506) to an attachment unit (508).

The method may further comprise configuring the attachment unit (508) with a spring loaded unit (404); operably connecting the spring loaded unit (404) to the retractable friction roller (104); and operably connecting a clamp (402) to the spring loaded unit (404).

The method may further comprise operably connecting a second motor (302) to a second communication unit (304) and the power source (108), and operably connecting the second communication unit (304) to the joystick (102).

The method may further comprise configuring the joystick (102) to be operably programmable to generate commands for operating the motor (112) and the second motor (302).

The method may further comprise connecting the second motor (302) to a second axle (114), and connecting the second axle (114) to a second rotor (116).

The method may further comprise mounting a second retractable friction roller (306) on the second axle (114), and placing the second roller (306) in contact with a second wheel (308) of the manual wheelchair (202).

The method may further comprise configuring the second retractable friction roller (306) with a centerless concave rim housing designed to provide a high friction surface facing the second wheel (308) of the manual wheelchair (202).

The method may further comprise attaching the second friction roller (306) to the top of the second wheel (308) behind the seating area (312).

The method may further comprise attaching a second engagement unit (310) to the manual wheelchair (202), wherein the second engagement unit (310) is configured to detachably attach the second friction roller (306) and the second wheel (308) of the wheelchair (202).

The method may further comprise configuring the second engagement unit (310) with a second lever (502); operably connecting the second lever (502) to a second lever mechanism unit (504); operably connecting the second lever mechanism unit (504) to a second turnbuckle (506); and operably connecting the second turnbuckle (506) to a second attachment unit (508).

The method may further comprise configuring the second attachment unit (508) with a second spring loaded unit (404); operably connecting the second spring loaded unit (404) to the second retractable friction roller (306); and operably connecting a second clamp (402) to the second spring loaded unit (404).

The method may further comprise attaching the friction roller (104) to a motor (112) and attaching the motor (112) to a bracket (704) operably coupled via a turnbuckle (506) with a lever (502) to releasably engage the friction roller (104) and a wheel (206) in response to operation of the lever (502).

The method may further comprise attaching the friction roller (104) to the top of the wheel (206) behind the wheelchair (202) seating area (312).

In an aspect, a method to move a wheelchair (202) is disclosed, the method comprising: configuring a friction roller (104) to releasably engage with a wheel (206) of a wheelchair (202), based on attaching the friction roller (104) to the wheelchair (202); configuring the friction roller (104) to drive when engaged the wheel (206) through a contact surface with the wheel (206) above the wheel (206) center and behind the wheelchair (202) seating area (312); configuring a motor (112) to rotate the friction roller (104); and moving the wheelchair (202) based on engaging the friction roller (104) and activating the motor (112) to turn the wheel (206) through force by the friction roller (104) against the contact surface with the wheel (206).

The method may further comprise configuring a second motor (302) to rotate a second friction roller (306) configured to drive a second wheel (308) through a contact surface with the second wheel (308) above the second wheel (308) center and behind the wheelchair (202) seating area (312), based on attaching the second friction roller (306) to the wheelchair (202).

The method may further comprise folding the wheelchair (202) while the friction roller (104) remains attached to the wheelchair (202) and the second friction roller (306) remains attached to the wheelchair (202).

The method may further comprise disengaging, by a user remaining seated in the wheelchair (202) seating area (312), the friction roller (104).

In the foregoing description, it will be readily appreciated by those skilled in the art that modifications may be made to the invention without departing from the concepts disclosed herein. Such modifications are to be considered as included in the following claims, unless the claims by their language expressly state otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present invention should not be limited by any of the above-described exemplary embodiments.

What is claimed is:

1. A method to convert a manual wheelchair (202) to an electronic wheelchair, the method comprising:

operably connecting a joystick (102) to a communication unit (110);

operably connecting the communication unit (110) to a motor (112);

connecting an axle (114) to a rotor (116);

connecting the motor (112) to the axle (114);

mounting a retractable friction roller (104) on the axle (114);

configuring the retractable friction roller (104) with a centerless concave rim housing designed to provide a high friction surface when the friction roller (104) is placed facing and in contact with a wheel (206);

placing the retractable friction roller (104) in contact with a wheel (206) of a manual wheelchair (202);

attaching to the wheelchair (202) an engagement unit (106) configured to detachably attach the retractable friction roller (104) and the wheel (206); and operably connecting a power source (108) to the motor (112) and the joystick (102).

2. The method of claim 1, wherein the method further comprises configuring a safety fender (509) to detachably attach to the wheelchair (202), wherein the safety fender (509) fits over the retractable friction roller (104) when the safety fender (509) is attached to the wheelchair (202).

3. The method of claim 2, wherein the method further comprises attaching at least one set of brushes (510) to the safety fender (509), wherein the at least one set of brushes (510), when attached to the safety fender (509), are in contact with the wheel (206), and wherein the safety fender (509) comprises a top, an open bottom, a right side, a left side, a proximal side and a distal side, wherein each of the sides has a bottom edge and the at least one set of brushes (510) is attached to the bottom edge of the distal side of the safety fender (509).

4. The method of claim 1, wherein the method further comprises configuring the engagement unit (106) with a lever (502); operably connecting the lever (502) to a lever mechanism unit (504); operably connecting the lever mechanism unit (504) to a turnbuckle (506); and operably connecting the turnbuckle (506) to an attachment unit (508).

5. The method of claim 4, wherein the method further comprises configuring the attachment unit (508) with a spring loaded unit (404); operably connecting the spring loaded unit (404) to the retractable friction roller (104); and operably connecting a clamp (402) to the spring loaded unit (404).

6. The method of claim 1, wherein the method further comprises operably connecting a second motor (302) to a second communication unit (304) and the power source (108), and operably connecting the second communication unit (304) to the joystick (102).

7. The method of claim 6, wherein the method further comprises configuring the joystick (102) to be operably programmable to generate commands for operating the motor (112) and the second motor (302).

8. The method of claim 6, wherein the method further comprises connecting the second motor (302) to a second axle (114), and connecting the second axle (114) to a second rotor (116).

9. The method of claim 8, wherein the method further comprises mounting a second retractable friction roller (306) on the second axle (114), and placing the second roller (306) in contact with a second wheel (308) of the manual wheelchair (202).

10. The method of claim 9, wherein the method further comprises configuring the second retractable friction roller (306) with a centerless concave rim housing designed to provide a high friction surface facing the second wheel (308) of the manual wheelchair (202).

11. The method of claim 9, wherein the method further comprises attaching the second friction roller (306) to the top of the second wheel (308) behind the seating area (312).

12. The method of claim 9, wherein the method further comprises attaching a second engagement unit (310) to the manual wheelchair (202), wherein the second engagement unit (310) is configured to detachably attach the second friction roller (306) and the second wheel (308) of the wheelchair (202).

13. The method of claim 12, wherein the method further comprises configuring the second engagement unit (310) with a second lever (502); operably connecting the second lever (502) to a second lever mechanism unit (504); operably connecting the second lever mechanism unit (504) to a second turnbuckle (506); and operably connecting the second turnbuckle (506) to a second attachment unit (508).

14. The method of claim 13, wherein the method further comprises configuring the second attachment unit (508) with a second spring loaded unit (404); operably connecting the second spring loaded unit (404) to the second retractable friction roller (306); and operably connecting a second clamp (402) to the second spring loaded unit (404).

15. The method of claim 1, wherein the method further comprises attaching the friction roller (104) to a motor (112) and attaching the motor (112) to a bracket (704) operably coupled via a turnbuckle (506) with a lever (502) to releasably engage the friction roller (104) and a wheel (206) in response to operation of the lever (502).

16. The method of claim 1, wherein the method further comprises attaching the friction roller (104) to the top of the wheel (206) behind the wheelchair (202) seating area (312).

* * * * *